United States Patent [19]

Fitzgerald

[11] 4,131,471

[45] Dec. 26, 1978

[54] SYNTHETIC POLYMERIC SILVER HALIDE PEPTIZER

[75] Inventor: Maurice J. Fitzgerald, Canton, Mass.

[73] Assignee: Polaroid Corporation, Cambridge, Mass.

[21] Appl. No.: 805,863

[22] Filed: Jun. 13, 1977

Related U.S. Application Data

[63] Continuation-in-part of Ser. No. 638,820, Dec. 8, 1975, abandoned, which is a continuation-in-part of Ser. No. 532,165, Dec. 12, 1974, abandoned, which is a continuation-in-part of Ser. No. 337,433, Mar. 2, 1973, abandoned.

[51] Int. Cl.[2] ..... G03C 1/72

[52] U.S. Cl. ..... 96/114

[58] Field of Search ..... 96/114

[56] References Cited

U.S. PATENT DOCUMENTS

| | | | |
|---|---|---|---|
| 2,852,382 | 9/1958 | Illingsworth et al. | 96/114 |
| 3,236,653 | 2/1966 | Vrancken et al. | 96/111 |
| 3,512,985 | 5/1970 | Harvey | 96/114 |
| 3,516,830 | 6/1970 | Whiteley | 96/67 |
| 3,554,987 | 1/1971 | Smith | 96/114 |
| 3,632,342 | 1/1972 | Salesin | 96/114 |
| 3,655,407 | 4/1972 | McGraw | 96/114 |
| 3,706,564 | 12/1972 | Hollister et al. | 96/114 |
| 3,713,834 | 1/1973 | Fitzgerald | 96/114 |

*Primary Examiner*—Jack P. Brammer

*Attorney, Agent, or Firm*—Esther A. H. Hopkins

[57] ABSTRACT

A photosensitive silver halide emulsion wherein the silver haiide peptizer comprises a halogenated acrylate polymer or copolymer.

28 Claims, No Drawings

SYNTHETIC POLYMERIC SILVER HALIDE PEPTIZER

This application is a continuation-in-part of copending application Ser. No. 638,820 filed Dec. 8, 1975 now abandoned which was a continuation-in-part of application Ser. No. 532,165 filed Dec. 12, 1974, now abandoned, which was a continuation-in-part of application Ser. No. 337,433 filed Mar. 2, 1973 now abandoned.

BACKGROUND OF THE INVENTION

This invention relates to photography and more particularly, to novel photosensitive photographic elements, particularly novel photosensitive emulsions.

As a result of the known disadvantages of gelatin, in particular, its variable photographic properties and its fixed physical properties, for example, its diffusion characteristics; much effort has been expended in the past in order to replace gelatin with a suitable synthetic grain-growing protective colloid for photographic silver halide emulsions. Many synthetic polymeric materials have heretofore been suggested as peptizers for silver halide emulsions, however, these have generally not functioned satisfactory and frequently have not fulfilled all of the basic requirements for a photosensitive silver halide emulsion grain-growing protective colloid listed following:

(1) absent (or constant) photographic activity;

(2) ability to form an adsorption layer on microcrystals of silver halide permitting stable suspensions to be obtained;

(3) ability to form adsorption layers as described in (2) above which do not prevent growth of silver halide microcrystals during physical ripening; and (4) solubility in water solution.

In addition, hithertofore, much emphasis has been placed on the ability of the snythetic polymeric material to mix with gelatin, as this property has been critical for employment in partial substitution reactions with gelatin. Consequently, many synthetic polymers of the prior art have been water-insoluble lattices which allow for the growth of silver halide crystals only in the presence of gelatin.

It is known from McDowell, U.S. Pat. No. 3,589,906 that certain perfluoro compounds, particularly those derived from saturated perfluoro carboxylic acids, perfluorosulfonic acids or perfluorosulfuric acids, are useful in photographic emulsions to eliminate repellency spots in coatings but not as emulsions peptizers. Certain halogenated vinyl compounds such as vinylchloride, have been employed as monomers in the preparation of synthetic silver halide emulsion binders, for example as described in Caldwell, U.S. Pat. No. 2,843,562; however, it has been heretofore unknown to employ polymers or copolymers having repeating halogenated acrylate units as peptizers.

SUMMARY OF THE INVENTION

The present invention is directed to a photosensitive silver halide emulsion wherein the silver halide crystals have adsorbed on their surface a substantially continuous layer of a water soluble film-forming polymeric silver halide grain-growing protective colloid having in its structure at least about one mole percent repeating units of the formula:

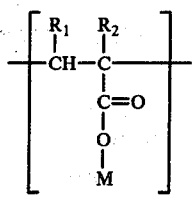

wherein $R_1$, is hydrogen, a lower alkyl group, i.e., 1–4 carbon alkyl group, preferably methyl or ethyl, or a halogen, i.e., fluoro, chloro, bromo, or iodo; $R_2$ is hydrogen, a lower alkyl group, a halogen or cyano group; M is $—CH_3$, $—CH_2Z$, or $—CHY_2$, where Z is $—CX_3$, $(CF_2)_rCF_3$ or $—(CF_2)_sH$, X being bromo, chloro or fluoro and r being 1–8 and s being 1–9 and Y is $—CH_2X$ or $—CX_3$, with at least one of $R_1$, $R_2$ or M comprising a halogen.

A preferred embodiment of the invention comprises a silver halide emulsion wherein the emulsion peptizer is a copolymer having 1–80 mole percent of the above-indicated repeating units and 20–99 mole percent of repeating units derived from an ethylenically unsaturated comonomer, e.g., acrylamide. The above-described polymers are herein designated for convenience as halogenated acrylate polymers.

DETAILED DESCRIPTION OF THE INVENTION

As indicated, the present invention is directed to photosensitive silver halide emulsions wherein photosensitive silver halide crystals have adsorbed on their surface a substantially continuous layer of a grain-growing protective colloid comprising a water-soluble film-forming halogenated acrylate polymer having in its structure repeating units represented by the formula set forth above. The term "film-forming" is intended to designate a molecular weight sufficiently high to form a film, for example, a molecular weight comparable to that of gelatin (i.e., around 15,000). Adsorption of this layer of synthetic grain-growing protective colloid on the surface of the silver halide crystal as the crystal is formed occurs because the synthetic colloid is used as the sole emulsifying agent during the precipitation of the silver halide crystal. As the crystal is formed, a substantially continuous layer is directly adsorbed on the surface. When the desired degree of ripening has been reached, other "bodying" polymers which determine overall diffusion characteristics of the bulk emulsion may be added, but the crystal growth, the crystal habit and, indeed, the major properties of the silver halide grain are determined by the polymer directly adsorbed on the surface, in this invention, the halogenated acrylate polymer detailed above.

Such polymers have been found to effective peptize silver halide emulsions in the absence of gelatin and to substantially meet all the basic requirements for a gelatin substitute without processing the deficiencies of gelatin as delineated above. The emulsions of the present invention are more stable against degradation than gelatin; in particular they are more stable against hydrolysis of the polymeric backbone in acidic or basic media. This stability is due, in large part, to the carbon-carbon linkages in the backbone of the instant polymers as opposed to the relatively easily hydrolyzable amide or ester linkages found in the polymeric backbone of gelatin. The polymers of this invention also show a resistance to the growth of microorganisms which is not exhibited by gelatin.

As examples of monomers represented by the formula:

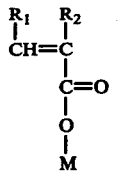

wherein $R_1$, $R_2$, and M have the above indicated definitions and which are contemplated as being suitable for providing the halogenated acrylate polymers of the instant invention, mention may be made of the following:

1. $CH_2{=}C(Cl){-}COO{-}CH_3$
methyl α-chloroacrylate
2. $CH_3CH{=}C(C{\equiv}N){-}COO{-}CH_2CBr_3$
2',2',2'-tribromoethyl 2-cyano-2-butenoate
3. $Cl{-}CH{=}CH{-}COO{-}CH_2CCl_3$
2,2,2-trichloroethyl β-chloroacrylate
4. $CH_2{=}CH{-}COO{-}CH_2CF_3$
2,2,2-trifluoroethyl acrylate
5. $CH_2{=}C(CH_3){-}COO{-}CH_2CF_3$
2,2,2-trifluoroethyl methacrylate
6. $CH_2{=}C(CH_3){-}COO{-}CH(CH_2{-}Cl){-}CH_2{-}Cl$
1,3-dichloroisopropyl methacrylate
7. $CH_2{=}CH{-}COO{-}CH_2CF_2CF_3$
2,2,3,3,3-pentafluoroprop-1-yl acrylate
8. $CH_2{=}CH{-}COO{-}CH(CF_3)_2$
1,1,1,3,3,3-hexafluoroisopropyl acrylate
9. $CH_2{=}C(CH_3){-}COO{-}CH(CF_3)_2$
1,1,1,3,3,3-hexfluoroisopropyl methacrylate
10. $CH_2{=}C(CH_3){-}COO{-}CH_2CF_2CF_2CF_2CF_2H$
2,2,3,3,4,4,5,5-octafluoro-n-pentyl methacrylate
11. $CH_2{=}CH{-}COO{-}CH_2CF_2CF_2CF_2CF_2CF_2CF_2CF_3$
2,2,3,3,4,4,5,5,6,6,6,7,7,8,8,8-pentadecafluoro-n-octyl acrylate Preferably, the instant polymers are interpolymers or copolymers having, in addition to the repeating units defined above, and compatible repeating unit or various repeating units which are not detrimental to photographic silver halide emulsions and which allow the resultant copolymer to be soluble in water. Examples of typical comonomers which may be employed in forming the copolymers suitable for use in the present invention include the following ethylenically-unsaturated monomers:

12. $CH_2{=}CH{-}COOH$
acrylic acid
13. $CH_2{=}C(CH_3){-}COOH$
methacrylic acid -continued 14. $CH_2{=}C(Cl){-}COOH$
α-chloroacrylic acid
15. $CH_2{=}C(Br){-}COOH$
α-bromoacrylic acid
16. $CH_3CH{=}CH{-}COOH$
crotonic acid
17. $CH_3CH{=}CH{-}COOH$
isocrotonic acid
18. $Cl{-}CH{=}CH{-}COOH$
β-chloroacrylic acid
19. $Br{-}CH{=}CH{-}COOH$
β-bromoacrylic acid
20. $Cl{-}CH{=}C(CH_3){-}COOH$
β-chloromethacrylic acid
21. $CH_2{=}CH{-}COO{-}CH_3$
methyl acrylate
22. $CH_2{=}C(CH_3){-}COO{-}CH_2CH_3$
ethyl methacrylate
23. $CH_2{=}C(Cl){-}COO{-}CH_2CH_2CH_3$
n-propyl-α-chloroacrylate
24. $Br{-}CH{=}CH{-}COO{-}CH(CH_3)_2$
isopropyl-β-bromoacrylate
25. $CH_2{=}C(CH_3){-}COO{-}CH_2CH(CH_3)_2$
isobutyl methacrylate
26. $CH_2{=}CH{-}COO{-}CH_2CH_2OH$
β-hydroxyethyl acrylate
27. $CH_2{=}CH{-}COO{-}CH_2CH_2CH_2OH$
γ-hydroxypropyl acrylate
28. $CH_2{=}C(CH_3){-}COO{-}CH_2CH(OH)CH_3$
2-hydroxy-n-propyl methacrylate
29. $CH_2{=}CH{-}CO{-}NH_2$
acrylamide
30. $CH_2{=}C(Cl){-}CO{-}NH_2$
α-chloroacrylamide
31. $CH_2{=}C(Br){-}CO{-}NH_2$
α-bromoacrylamide
32. $CH_2{=}C(CH_3){-}CO{-}NH_2$
methacrylamide
33. $CH_2{=}C(CH_2CH_3){-}CO{-}NH_2$
αethylacrylamide
34. $Cl{-}CH{=}C(CH_3){-}CO{-}NH_2$
β-chloromethacrylamide
35. $Br{-}CH{=}C(Br){-}CO{-}NH_2$
2,3-dibromoacrylamide
36. $CH_3CH{=}CH{-}CO{-}NH_2$
crotonamide
37. $CH_2{=}C(CH_3){-}CO{-}NH{-}CH_3$
N-methylmethacrylamide
38. $CH_2{=}CH{-}CO{-}N(CH_3)_2$
N,N-dimethylacrylamide
39. $CH_2{=}C(Cl){-}CO{-}NH{-}CH_2CH_3$
N-ethyl-α-chloroacrylamide
40. $CH_2{=}CH{-}CO{-}NH{-}C(CH_3)_3$
N-tertiary butylacrylamide -continued 41. 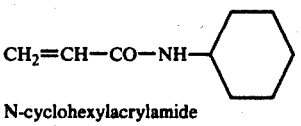

N-cyclohexylacrylamide

42. $CH_2{=}CH{-}CO{-}NH{-}C(CH_3)_2{-}CH_2{-}C(CH_3)_3$

N-tertiary octyl acrylamide

43. $CH_2{=}CH{-}CO{-}NH{-}CH_2OH$

N-methylolacrylamide

44. $CH_2{=}CH{-}CO{-}NH{-}CH_2CH_2OH$

N-(β-hydroxyethyl) acrylamide

45. $CH_2{=}CH{-}CO{-}NH{-}C(CH_3)_2{-}CH_2{-}C(=O){-}CH_3$ diacetone acrylamide

46. $CH_2{=}CH{-}CO{-}NH{-}CH(CH_3)_2$

N-isopropylacrylamide

47. 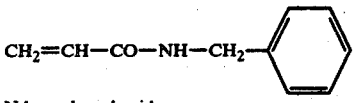

N-benzylacrylamide

48. $CH_2{=}CH{-}O{-}CH_3$ methylvinyl ether

49. $CH_2{=}C(Cl){-}O{-}CH_2CH_3$ ethyl α-chlorovinyl ether

50. $CH_2{=}CH{-}O{-}CH_2CH_2Cl$

β-chloroethyl vinyl ether

51. $CH_2{=}CH{-}O{-}CH_2CH_2{-}OCH_3$

β-methoxyethyl vinyl ether

52. $CH_2{=}C(CH_3){-}O{-}CH_2CH(CH_3)_2$ isobutyl isopropenyl ether

53. $CH_2{=}CH{-}O{-}CH_2CH_2CH_2CH_2CH_2{-}CH(CH_3)_2$ isooctyl vinyl ether

54. $CH_2{=}CH{-}C(=O){-}CH_3$ methylvinyl ketone

55. $CH_2{=}C(CH_3){-}C(=O){-}CH_2CH_3$ ethyl isopropenyl ketone

56. $CH_2{=}C(Cl){-}C(=O){-}CH_2CH_2CH_3$ n-propyl-α-chlorovinyl ketone

57. $CH_2{=}C(Br){-}C(=O){-}CH_2CH_2{-}O{-}CH_3$

β-methoxyethyl-α-bromovinyl ketone

58. $CH_2{=}C(CH_2CH_3){-}C(=O){-}CH_2CH_2OH$

β-hydroxyethyl-1-butene-2-yl ketone

59. $CH_2{=}CH{-}CHO$ acrolein

60. $CH_3{-}CH{=}CH{-}CHO$ crotonaldehyde

61. $CH_2{=}C(Cl){-}CHO$

α-chloroacrolein

62. $CH_2{=}C(Br){-}CHO$

α-bromoacrolein

63. $CH_2{=}CH{-}C{\equiv}N$ acrylonitrile

64. $CH_3CH{=}CH{-}C{\equiv}N$ crotononitrile

65. $CH_2{=}C(Cl){-}C{\equiv}N$

α-chloroacrylonitrile

66. $CH_2{=}C(Br){-}C{\equiv}N$

α-bromoacrylonitrile

-continued

67. $BrCH{=}C(CH_3){-}C{\equiv}N$

β-bromomethacrylonitrile

68. $ClCH{=}C(CH_2CH_3){-}C{\equiv}N$

β-chloroethacrylonitrile

69. $CH_2{=}C(C{\equiv}N){-}COO{-}CH_3$ methyl α-cyanoacrylate

70. $CH_2{=}CH{-}CO{-}NH{-}CH_2{-}CO{-}NH_2$ acrylamidoacetamide

71. $CH_2{=}C(CH_3){-}CO{-}NH{-}CH_2{-}CO{-}NH_2$ methacrylamidoacetamide

72. $CH_3CH{=}CH{-}CO{-}NH{-}CH(CH_3){-}CO{-}NH{-}CH_3$ 2-crotonamido-N-methylpropionamide

73. $CH_2{=}CH{-}CO{-}NH{-}CH(CH_3){-}CO{-}NH_2$ 2-acrylamidopropionamide

74. $CH_2{=}C(CH_3){-}CO{-}NH{-}CH(CH_3){-}CO{-}NH_2$ 2-methacrylamidopropionamide 75. $CH_2{=}C(Cl){-}CO{-}NH{-}CH(CH(CH_3)_2){-}CO{-}NH_2$ 2-(α-chloroacrylamido)-3-methylbutyramide

76. $CH_2{=}CH{-}CO{-}NH{-}CH_2{-}NH{-}CO{-}CH_3$

N-(acetamidomethyl)acrylamide

77. $CH_2{=}C(CH_3){-}CO{-}NH{-}CH_2{-}NH{-}CO{-}CH_2CH_3$

N-(propionamidomethyl)methacrylamide

78. $CH_2{=}C(Cl){-}CO{-}NH{-}CH_2{-}NH{-}CO{-}CH_2CH_2CH_3$

N-(n-butyramidomethyl) α-chloroacrylamide

79. 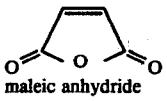

maleic anhydride

80. $HOOC{-}CH{=}CH{-}COOH$ maleic acid

81. $HOOC{-}CH{=}CH{-}CO{-}NH_2$ maleic acid amide

82. $HOOC{-}CH{=}CH{-}CO{-}NH{-}CH_2CH_3$

N-ethylmaleic acid amide

83. $CH_3{-}OOC{-}CH{=}CH{-}CO{-}NH{-}CH_3$

N-methyl methylmaleate amide

84. $CH_2{=}CH{-}OOCH$ vinylformate

85. $CH_2{=}CH{-}OOC{-}CH_3$ vinyl acetate

86. $CH_2{=}CH{-}OH$ (obtained by hydrolyzing copolymerized vinyl acetate)

vinyl alcohol

87. $CH_2{=}C(CH_3){-}OOC{-}CH_2Br$ isopropenyl bromoacetate

88. $CH_2{=}CH{-}OOC{-}C(CH_3)_3$ vinyl pivalate

89. $CH_2{=}CH{-}NH{-}COO{-}C(CH_3)_3$

N-vinyl-tertiary butylcarbamate

90. $CH_2{=}C(COOH){-}CH_2{-}COO{-}CH_2CH_3$ ethyl-3-carboxy-3-butenate

91. 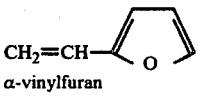

α-vinylfuran

92. 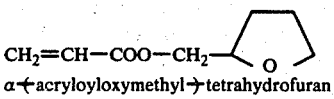

α-(acryloyloxymethyl)tetrahydrofuran

-continued

93.

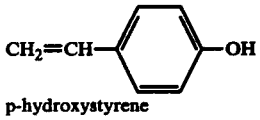

p-hydroxystyrene

94.

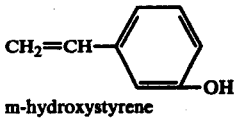

m-hydroxystyrene

95.

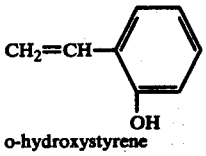

o-hydroxystyrene

96.

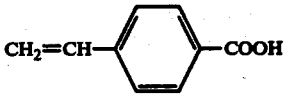

p-carboxystyrene

97.

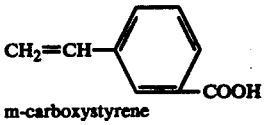

m-carboxystyrene

98.

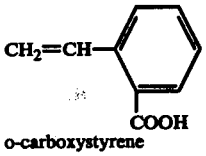

o-carboxystyrene

99. $CH_2=CH-N$

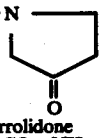

N-vinyl-2-pyrrolidone

100. $CH_2=CH-CO-NH-CH_2CH_3$

N-ethylacrylamide

101. $CH_2=CH-CO-NH-\underset{\underset{COOH}{|}}{CH}-CH-(CH_3)_2$

N-acryloylvaline

102. $CH_2=CH-CO-NH-\underset{\underset{COOH}{|}}{CH}-CH_2-CH_2-S-CH_3$

N-acryloylmethionine

103. $CH_2=CH-CO-NH-\underset{\underset{CO-NH_2}{|}}{CH}-CH_2-CH_2-S-CH_3$

N-acryloylmethionamide

104. $CH_2=\overset{\overset{CH_3}{|}}{C}-CO-NH-\underset{\underset{COOH}{|}}{CH}-CH_2-CH_2-S-CH_3$ N-methacryloylmethionine Polymerization of the indicated monomers is achieved by conventional free radical polymerization techniques.

The following non-limiting examples illustrate the preparation of polymers within the scope of the present invention. The numerical ratio before the word copolymer in the following examples refers to the molar ratio of monomers in the reaction mixture forming the copolymer.

EXAMPLE 1

20:1 copolymer of acrylamide and pentadecafluoro-n-octyl acrylate (compound #11 supra).

7.11 g of acrylamide, 4.54 g of pentadecafluoro-n-octyl acrylate (see *Journal of Polymer Science,* Vol. XV pps. 515, 519 for preparation) and 0.01 g of 2,2'-azobis-[2-methylpropionitrile] were dissolved in about 80 mls of dimethylformamide. This solution was polymerized under $N_2$ in a sealed tube at 65° C. for 12 hours, and then precipitated in acetone. The precipitate was dried under vacuum at 45° C. overnight to yield a white powder which was soluble in water and dimethylformamide.

EXAMPLE 2

5:1 copolymer of acrylamide and methyl-α-chloroacrylate (compounds #1 supra).

The procedure of Example 1 was followed employing 3.01 g of methyl-α-chloroacrylate as the halogenated monomer.

EXAMPLE 3

8:1 copolymer of acrylamide and 1,3-dichloroisopropyl methacrylate (compound #6 supra).

The procedure of Example 1 was followed employing 3.94 g of 1,3-dichloroisopropyl methacrylate as the halogenated monomer.

EXAMPLE 4

21:2 copolymer of acrylamide and 2,2,2-trifluorethyl methacrylate (compound #5 supra).

The procedure of Example 1 was followed employing 1.68 g of 2,2,2-trifluoroethyl methacrylate (commercially available from PCR, Inc., Gainesville, Fla., under the designation "01-14377-02") as the halogenated monomer.

EXAMPLE 5

21:2 copolymer of acrylamide and pentafluoroprop-1-yl acrylate (compound #7 supra).

The procedure of Example 1 was followed employing 2.04 g of pentafluoro-prop-1-yl acrylate (commercially available from PCR, Inc. under the designation "02-14090-06") as the halogenated monomer.

EXAMPLE 6

23:2 copolymer of acrylamide and hexafluoroisopropyl acrylate (compound #8 supra).

The procedure of Example 1 was followed employing 2.22 g of hexafluoroisopropyl acrylate (commercially available from Polysciences, Inc., Warrington, Pa.) as the halogenated monomer.

EXAMPLE 7

9:2 copolymer of acrylamide and trifluoroethyl methacrylate (compound #5 supra).

The procedure of Example 1 was followed employing 8.53 g of acrylamide and 5.52 g of 2,2,2-trifluoroethyl methacrylate as the monomers.

EXAMPLE 8

4:1 copolymers of acrylamide and trifluoroethyl acrylate (compound #4 supra).

The procedure of Example 1 was followed employing 8.53 g of acrylamide and 5.10 g of 2,2,2-trifluoroethyl acrylate (commercially available from PCR, Inc. under the designation "02-14110-01") as the monomers.

EXAMPLE 9

10:1 copolymer of acrylamide and 2,2,2-trifluoroethyl acrylate (compound #4 supra).

The procedure of Example 1 was followed employing 1.54 g of 2,2,2-trifluoroethyl acrylate as the halogenated monomer.

EXAMPLE 10

21:1 copolymer of acrylamide and octafluoro-n-pentyl methacrylate (compound #10 supra).

The procedure of Example 1 was followed employing 1.50 g of octafluoro-n-pentyl methacrylate (commercially available from PCR, Inc. under the designation "01-14370-01") as the halogenated monomer.

EXAMPLE 11

11:1 copolymer of acrylamide and hexafluoroisopropyl methacrylate (compound #8 supra).

The procedure of Example 1 was followed employing 5.90 g of hexafluoroisopropyl methacrylate (commercially available from Polysciences, Inc.) as the halogenated monomer.

The following general procedure may be used for preparing photographic emulsions using the above-described polymers of the instant invention as the sole peptizing agent for silver halide.

A water-soluble silver salt, such as silver nitrate, may be reacted with at least one water-soluble halide, such as potassium, sodium, or ammonium bromide, preferably together with potassium, sodium, or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as gelatin or a polyvinyl alcohol, preferably having an average molecular weight of about 100,000 (commercially available from E. I. duPont deNemours & Company, Wilmington, Del., designated Type 72-60). A surfactant, such as dioctyl ester of sodium sulfosuccinic acid, designated Aerosol OT, (commercially available from American Cyanamid Company, New York, N.Y.), may be added and the emulsion coated onto a film base of cellulose triacetate sheet having a coating of hardened gelatin.

Alternatively, the soluble salts may be removed by adding to the emulsion a solution of polyacid, such as 1:1 ethylene:maleic acid copolymer, and lowering the pH to below 5, thereby bringing about precipitation of the polyacid carrying the silver halide grains along with the precipitate. The resulting precipitate may then be washed and resuspended by redissolving the polyacid at pH 6–7.

The emulsions may be chemically sensitized with sulfur compounds such as sodium thiosulfate or thiourea, with reducing substances such as stannous chloride; with salts of noble metals such as gold, rhodium and platinum; with amines and polyamines; with quaternary ammonium compounds such as alkyl $\alpha$-picolinium bromide; and with polyethylene glycols and derivatives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived from naturally occurring products. As examples of specific materials which may serve as supports, mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivatives such as cellulose acetate, triacetate, nitrate, propionate, butyrate, acetate propionate, and acetate butyrate. Suitable subcoats may be provided on the supports, for example a layer of gelatin, if necessary or desirable for adherence, as is well known in the art.

As previously indicated, preferably copolymers employed in the practice of the instant invention may contain from about 1–80 mole % of the above-indicated halogenated acrylate repeating units. Polymers with more than about 80 mole % of these units tend to be less soluble in water. The specific amount employed may be selected by the operator depending upon the grain particle size and habit desired.

By selecting appropriate comonomers, the copolymers may be made to be compatible with all water-soluble bodying polymers. Emulsions made from these copolymers may be bodied with any water-soluble polymers, overcoming the disadvantage encountered with gelatin which is only compatible with a very few polymers in a most limited pH range. As examples of specific materials which may serve as bodying polymers are gelatin, polyvinyl alcohol, polyacrylamide, polyalkylacrylamides, polyvinyl pyrrolidone, polymethacrylamidoacetamide, vinyl alcohol/N-vinylpyrrolidone copolymers, poly-N-ethylaziridine, poly-n-(2-hydroxyethyl) aziridine, poly-N-(2-cyanoethyl) aziridine, poly ($\beta$-hydroxyethyl acrylate), polyethylene imine and cellulose derivatives such as hydroxyethyl cellulose, hydroxypropyl cellulose and methyl cellulose. It has been found that using only a small amount of one or more of the instant copolymers, large amounts of photosensitive silver halide grains may be obtained. An emulsion made from one of these copolymers of the instant invention may therefore be bodied with a water-soluble polymer such that the polymeric constitution of the resulting emulsion comprises a relatively large percentage of the bodying polymer.

By selecting appropriate comonomers, copolymers with selected diffusion characteristics may be prepared. For example, the rate diffusion of alkali ion or a dye-developer through an emulsion comprising one of the copolymers of this invention may be modified by varying the composition of the copolymer.

The instant copolymers containing acidic comonomers may be pH flocculated in order to remove the soluble salts formed as a byproduct of the double decomposition reaction between the water-soluble silver salt and the water-soluble halide, in addition to any unreacted excess of the initial salts. As an example, an acid copolymer may be precipitated by lowering the pH below 5 and thus washed and resuspended by raising the pH to above 7.

The instant invention will be further illustrated by reference to the following nonlimiting examples:

EXAMPLE 12

A solution of 4.15 g of a dry 5:1 copolymer of acrylamide/methyl-α-chloro acrylate as prepared in Example 2 above, in 266 ml. of distilled water, was adjusted to pH 3.0 with dilute nitric acid and maintained at a temperature of 55° C. To this solution, 44.0 g of dry potassium bromide and 1.00 g of dry potassium iodide were added.

A solution of 55 g of silver nitrate in 500 ml of distilled water was repeated. From this silver nitrate solution, 100 ml was rapidly added with continuous agitation to the polymer-halide solution and the remainder was added over a period of 22 minutes. Thereafter, the emulsion was ripened for 60 minutes at 55° C., and then rapidly cooled to below 20° C.

EXAMPLE 13

The procedure of Example 12 with twice as much potassium bromide (i.e. 88.0 g) was employed to prepare a silver halide emulsion with the 10:1 acrylamide/-trifluoroethyl acrylate copolymer of Example 9 as the emulsion peptizer.

EXAMPLE 14

An additional emulsion was prepared according to the procedure of Example 13, except that the 4:1 acrylamide/trifluoroethyl acrylate copolymer of Example 8 was used as the emulsion peptizer.

EXAMPLE 15

Another emulsion was prepared according to the procedure of Example 13, except that the 21:2 acrylamide/trifluoroethyl methacrylate copolymer of Example 4 was used as the emulsion peptizer.

EXAMPLE 16

Another emulsion was prepared according to the procedure of Example 13, except that the 9:1 acrylamide/trifluoroethyl methacrylate of Example 7 was used as the emulsion peptizer.

EXAMPLE 17

Another emulsion was prepared according to the procedure of Example 13, except that the 21:2 acrylamide/pentafluoropropyl acrylate copolymer of Example 5 was used as the emulsion peptizer.

EXAMPLE 18

Another emulsion was prepared according to the procedure of Example 13, except that the 23:2 copolymer of acrylamide/hexafluoroisopropyl acrylate copolymer of Example 6 was used as the emulsion peptizer.

EXAMPLE 19

Another emulsion was prepared according to the procedure of Example 13, except that the 20:1 acrylamide/pentadecafluoro-n-octyl acrylate copolymer of Example 1 was used as the emulsion peptizer.

EXAMPLE 20

A solution of 1.04 g of the dry 11:1 acrylamide/hexafluoroisopropyl methacrylate copolymer of Example 11 in 66.5 ml. of distilled water was adjusted to pH 3.0 with dilute nitric acid and maintained at a temperature of 55° C. To this solution, 22.0 g of dry potassium bromide and 0.25 g of dry potassium iodide were added.

A solution of 13.75 g of silver nitrate in 125 ml. of distilled water was prepared. From this silver nitrate solution, 25 ml. was rapidly added with continuous agitation to the polymer-halide solution and the remainder was added over a period of 22 minutes. Thereafter, the emulsion was ripened for 60 minutes at 55° C., and then rapidly cooled to below 20° C.

EXAMPLE 21

A solution of 2.08 g of the dry 8:1 acrylamide/dichloroisopropyl methacrylate copolymer of Example 3 in 133 ml. of distilled water was adjusted to pH 3.0 with dilute nitric acid and maintained at a temperature of 55° C. To this solution, 22.0 g of dry potassium bromide and 0.50 g of dry potassium iodide were added.

A solution of 55 g of silver nitrate in 250 ml. of distilled water was prepared. From this silver nitrate solution, 50 ml was rapidly added to the polymer-halide solution and the remainder was added over a period of 11 minutes. Thereafter, the emulsion was ripened for 41 minutes at 55° C., with continuous agitation, at the end of which it was rapidly cooled to below 20° C.

EXAMPLE 22

A solution of 4.15 g of the dry 21:1 acrylamide/octafluoropentyl methacrylate copolymer of Example 10 in 266ml of distilled water was adjusted to pH 3.0 with dilute nitric acid and maintained at a temperature of 55° C. To this solution, 44.0 g of dry potassium bromide and 0.50 g of dry potassium iodide were added.

A solution of 55 g of silver nitrate in 500 ml of distilled water was prepared. From this silver nitrate solution, 100 ml. was rapidly added to the polymer-halide solution and the remainder was added over a period of 22 minutes. Thereafter, the emulsion was ripened for 30 minutes at 55° C., with continuous agitation, at the end of which it was rapidly cooled to below 20° C.

EXAMPLE 23

(Control)

An emulsion was prepared following the procedure of Example 22, except that gelatin was employed as the peptizer rather than the synthetic polymer, and the pH of the polymer solution was adjusted to 6.3 rather than 3.0.

The following table summarizes the silver halide grain sizes obtained in the emulsions prepared in the above examples, all of which contained octahedral platelet crystals:

TABLE I

| Example | Copolymer | Approximate Grain Size (microns) Range | Average |
|---|---|---|---|
| 12 | 5:1 acrylamide/methyl-α-chloro acrylate (Example 2) | 0.2–3.2 | 0.7 |
| 13 | 10:1 acrylamide/trifluoroethyl acrylate (Example 9) | 0.4–2.2 | 1.0 |
| 14 | 4:1 acrylamide/trifluoroethyl acrylate (Example 9) | 0.6–6.0 | 2.0 |
| 15 | 21:2 acrylamide/trifluoroethyl methacrylate (Example 4) | — | 1.0 |
| 16 | 9:2 acrylamide/trifluoroethyl methacrylate (Example 7) | 0.6–3.4 | 1.5 |
| 17 | 21:2 acrylamide/pentafluoropropyl acrylate (Example 5) | 0.4–6.6 | 1.4 |

TABLE I-continued

| Example | Copolymer | Approximate Grain Size (microns) Range | Average |
|---|---|---|---|
| 18 | 23:2 acrylamide/ hexafluoropropyl acrylate (Example 6) | 0.4–2.0 | 0.8 |
| 19 | 20:1 acrylamide/ pentadecafluoro-n-octyl acrylate (Example 1) | 0.3–4.5 | 1.0 |
| 20 | 11:1 acrylamide/ hexafluoroisopropyl methacrylate (Example 11) | 0.3–1.8 | 0.8 |
| 21 | 8:1 acrylamide/ dichloroisopropyl methacrylate (Example 3) | 0.2–3.0 | 0.8 |
| 22 | 21:1 acrylamide/ octafluoropentyl methacrylate (Example 10) | — | 1.0 |
| 23 | Gelatin | 0.2–1.8 | 1.0 |

In certain photographic applications, it may be desirable to replace part, but not all, of the gelatin in the photosensitive emulsion. In view of the characteristics of the polymers described above, and further, in view of their compatability with gelatin in substantially all proportions, it will be obvious that these polymers may also be suited for such use.

The term "photosensitive" and other terms of similar import are herein employed in the generic sense to describe materials possessing physical and chemical properties which enable them to form usable images when photoexposed by radiation actinic to silver halide.

Since certain changes may be made in the above products and processes without departing from the scope of the invention herein involved, it is intended that all matter contained in the above description shall be interpreted as illustrative only and not in a limiting sense.

What is claimed is:

1. A photosensitive silver halide emulsion wherein the silver halide grains have absorbed on their surface a substantially continuous layer of an emulsion peptizer consisting essentially of a water soluble film-forming polymeric silver halide grain-growing protective colloid having in its structure at least about one mole percent repeating units of the formula

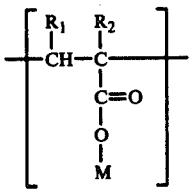

wherein $R_1$ is hydrogen, a lower alkyl group comprising a 1–4 carbon atom group, or halogen; $R_2$ is hydrogen, a lower alkyl group comprising a 1–4 carbon atom group, a halogen or cyano group; M is $—CH_2Z$ or $—CHY_2$ where Z is $—CX_3$, $—(CF_2)_rCF_3$ or $—(CF_2)_sH$ where X is —Br, —Cl or —F, r is 1–8 and s is 1–9; and Y is $—CH_2X$ or $—CX_3$, and at least one of $R_1$, $R_2$, or M comprises a halogen.

2. The product as defined in claim 1 wherein said polymeric peptizer comprises a copolymer of a first monomer of the formula:

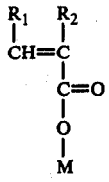

and a second ethylenically unsaturated monomer.

3. The product as defined in claim 2 wherein said first monomer is 2,2,2-trifluoroethyl acrylate.

4. The product as defined in claim 2 wherein said first monomer is 2,2,2-trifluoroethyl methacrylate.

5. The product as defined in claim 2 wherein said first monomer is 1,3-dichloroisopropyl methacrylate.

6. The product as defined in claim 2 wherein said first monomer is 2,2,3,3,3-pentafluoroprop-1-yl acrylate.

7. The product as defined in claim 2 wherein said first monomer is 1,1,1,3,3,3-hexafluoroisopropyl acrylate.

8. The product as defined in claim 2 wherein said first monomer is 1,1,1,3,3,3-hexafluoroisopropyl methacrylate.

9. The product as defined in claim 2 wherein said first monomer is 2,2,3,3,4,4,5,5-octafluoro-n-pentyl methacrylate.

10. The product as defined in claim 2 wherein said first monomer is 2,2,3,3,4,4,5,5,6,6,7,7,8,8,8-pentadecafluoro-n-octyl acrylate.

11. The product as defined in claim 2 wherein said second monomer is acrylamide.

12. The product as defined in claim 1 which includes a bodying polymer.

13. The product as defined in claim 12 wherein said bodying polymer is polyvinyl alcohol.

14. A process for preparing a photosensitive silver halide emulsion comprising reacting a water-soluble silver salt with a water-soluble halide salt in an aqueous solution containing a silver halide peptizer;

said peptizer consisting essentially of a water-soluble film-forming polymeric silver halide grain-growing protective colloid having in its structure at least about one mole percent repeating units of the formula:

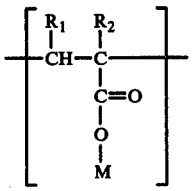

wherein $R_1$ is hydrogen, a lower alkyl group comprising a 1–4 carbon atom group or a halogen; $R_2$ is hydrogen, a lower alkyl group comprising a 1–4 carbon atom group, a halogen or cyano group; M is $—CH_2Z$ or $—CHY_2$ where Z is $—CX_3$, $—(CF_2)_rCF_3$ or $—(CF_2)_sH$ where X is —Br, —Cl or —F, r is 1–8 and s is 1–9; and Y is $—CH_2X$ or $—CX_3$, and at least one of $R_1$, $R_2$ or M comprises a halogen.

15. The process as defined in claim 14 wherein said polymer comprises a copolymer of a first monomer of the formula:

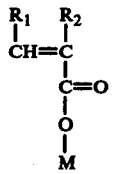

and a second ethylenically unsaturated monomer.

16. The process as defined in claim 15 wherein said first monomer is 2,2,2-trifluoroethyl acrylate.

17. The process as defined in claim 15 wherein said first monomer is 2,2,2-trifluoroethyl methacrylate.

18. The process as defined in claim 15 wherein said first monomer is 1,3-dichloroisopropyl methacrylate.

19. The process as defined in claim 15 wherein said first monomer is 2,2,3,3,3-pentafluoroprop-1-yl acrylate.

20. The process as defined in claim 15 wherein said first monomer is 1,1,1,3,3,3-hexafluoroisopropyl acrylate.

21. The process as defined in claim 15 wherein said first monomer is 1,1,1,3,3,3-hexafluoroisopropyl methacrylate.

22. The process as defined in claim 15 wherein said first monomer is 2,2,3,3,4,4,5,5-octafluoro-n-pentyl methacrylate.

23. The process as defined in claim 15 wherein said first monomer is 2,2,3,3,4,4,5,5,6,6,7,7,8,8,8-pentadecafluoro-n-octyl acrylate.

24. The process as defined in claim 15 wherein said second monomer is acrylamide.

25. The process as defined in claim 14 wherein said aqueous solution includes a bodying polymer.

26. The process as defined in claim 25 wherein said bodying polymer is polyvinyl alcohol.

27. The process as defined in claim 14 which further comprises:

precipitating silver halide from said emulsion;

removing soluble by-products from said silver halide by a washing procedure; and redispersing said silver halide in a bodying polymer.

28. The process as defined in claim 27 wherein said bodying polymer is gelatin.

* * * * *